US011759021B2

(12) United States Patent
Cervantes

(10) Patent No.: US 11,759,021 B2
(45) Date of Patent: Sep. 19, 2023

(54) FLOTATION DEVICE IN THE FORM OF A VEHICLE

(71) Applicant: Jesse M. Cervantes, San Lorenzo, CA (US)

(72) Inventor: Jesse M. Cervantes, San Lorenzo, CA (US)

( * ) Notice: Subject to any disclaimer, the term of this patent is extended or adjusted under 35 U.S.C. 154(b) by 394 days.

(21) Appl. No.: 17/150,241

(22) Filed: Jan. 15, 2021

(65) Prior Publication Data

US 2021/0219733 A1 Jul. 22, 2021

Related U.S. Application Data

(60) Provisional application No. 62/962,859, filed on Jan. 17, 2020.

(51) Int. Cl.

| | |
|---|---|
| ***A47C 15/00*** | (2006.01) |
| ***A47C 7/62*** | (2006.01) |
| ***A63H 23/10*** | (2006.01) |
| *A47C 7/72* | (2006.01) |

(52) U.S. Cl.

CPC ..... *A47C 15/006* (2013.01); *A47C 7/624* (2018.08); *A63H 23/10* (2013.01); *A47C 7/727* (2018.08)

(58) Field of Classification Search

CPC ..... A47C 15/006; A47C 7/624; A47C 7/727; A47C 4/54; A63H 23/10; A63H 17/00; B63B 34/50; B63B 34/52; B63B 34/54

USPC ..... D21/433, 809

See application file for complete search history.

(56) References Cited

U.S. PATENT DOCUMENTS

| | | | | |
|---|---|---|---|---|
| 5,224,891 A * | 7/1993 | Stephens | A47C 15/006 441/130 |
| 6,257,943 B1 | 7/2001 | Peterson | |
| D563,500 S * | 3/2008 | Gong | D21/816 |
| 10,194,224 B2 | 1/2019 | Cohen et al. | |
| D898,150 S * | 10/2020 | Barrett | D21/809 |

FOREIGN PATENT DOCUMENTS

KR 101327304 B1 11/2013

OTHER PUBLICATIONS

Amazon.com, FUNBOY Giant Inflatable Red Sports Car Pool Float, Luxury Float for Summer Pool Parties and Entertainment, https://www.amazon.com/dp/B07PRNJYCK/ref-twister_B07VSWS4HF?_encoding-UTF8&psc-1 [Date accessed: Oct. 13, 2019].

Amazon.com, Swimline Inflatable Pool Buggy Float, https://www.amazon.com/Swimline-Pool-Buggy-Car-Float/dp/B00BY0YO7A [Date accessed: Oct. 13, 2019].

* cited by examiner

*Primary Examiner* — Andrew Polay
(74) *Attorney, Agent, or Firm* — Bold IP, PLLC; Christopher Mayle

(57) ABSTRACT

A flotation device is described that provides a means for relaxation and enjoyment when used in a pool, lake, or other body of water. The flotation device is inflatable and includes a body configured in the form of a vehicle having a front side, a back side, a right side, and a left side. The flotation device further includes a seating area within an interior of the body of the flotation device, two side view mirrors, and a windshield frame. The body of the flotation device is configured to resemble a convertible version of a muscle car including doors, tires, and accompanying logos and details associated with a muscle car. The convertible version of the muscle car further includes a convertible roof that is folded and in an open position as displayed on the flotation device.

12 Claims, 5 Drawing Sheets

FLOTATION DEVICE IN THE FORM OF A VEHICLE

CROSS-REFERENCE TO RELATED APPLICATIONS

This application is a non-provisional patent application which claims priority to U.S. Provisional Patent Application No. 62/962,859, which was filed on Jan. 17, 2020, which is incorporated by reference in the entirety.

FIELD OF THE DISCLOSURE

The present invention relates to a recreational flotation device, and particularly to an inflatable recreational flotation device for use in pools, lakes, and other bodies of water.

BACKGROUND

A flotation device, such as inflatable or floating raft, is well known for use in recreational water activities. The flotation device typically accommodates a single user and has a form and/or design meant to accommodate the single user. Often the flotation device includes aesthetic features adding to the relaxation experience when using the flotation device.

In light of the foregoing, it would be desirable to provide a flotation device in a form that is able to carry more than one individual while providing a relaxation experience for all using the flotation device. Additionally, it would be desirable for the flotation device to be in a form reflective of the user's personal tastes or interests that increases the enjoyment value of using the flotation device in a pool, lake, or other body of water.

SUMMARY

According to one embodiment, one or more embodiments are provided below for a flotation device having a body configured in the form of a vehicle. The body of the flotation device has a front side, a back side, a right side, and a left side. In one or more non-limiting embodiments, the flotation device may include two side mirrors and a windshield frame.

The present description may further include one or more embodiments, wherein the flotation device is inflatable. The flotation device may include a body configured to resemble a muscle car, wherein the muscle car includes doors, tires, and accompanying logos and decals associated with the muscle car. In one or more non-limiting embodiments, the flotation device may further include a body configured to resemble a convertible version of a muscle car. The convertible version of the muscle car may have a convertible roof, whereby the convertible roof is folded and in an open position as displayed on the body of the flotation device.

In one or more non-limiting embodiments, the flotation device may further include a seating area within an interior of the body of the flotation device, whereby the seating area is configured to accommodate a minimum of two adults. The seating area of the flotation device may further include one or more cupholders as part of the seating area.

In one or more non-limiting embodiments, the flotation device may further include an open area located behind the seating area and in the back of the flotation device for the placement of one or more useful items. The flotation device may further include speaker holders located behind the seating area for the placement of portable speakers.

In one or more non-limiting embodiments, the flotation device is customizable in terms of size, shape, and color. Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
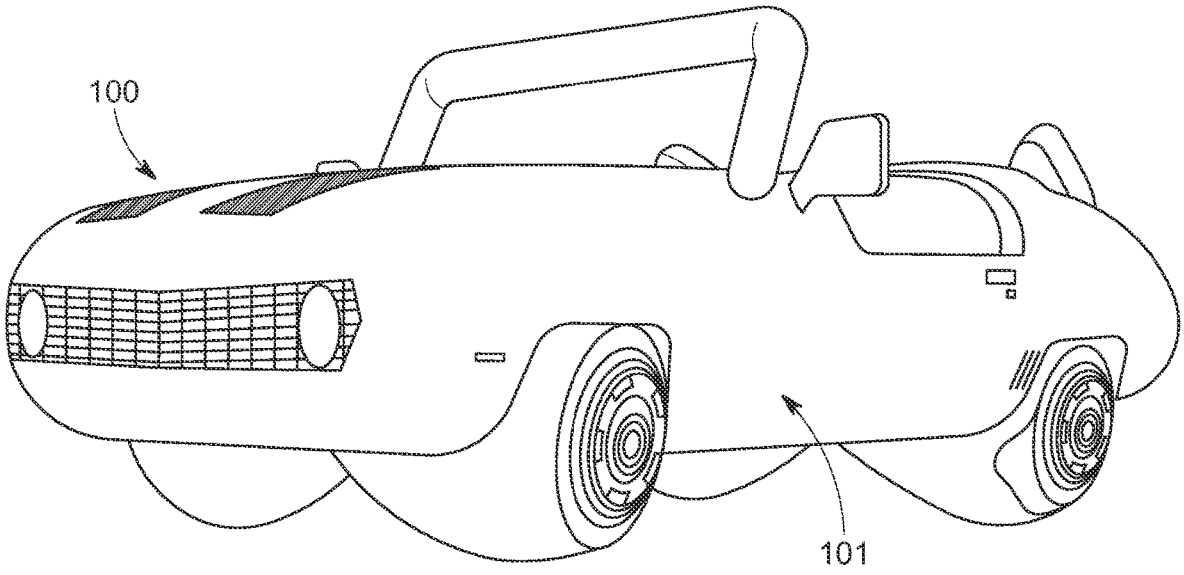
FIG. 1 is a pictorial illustration of an exemplary embodiment of a flotation device in the form of a vehicle.

In the Summary above and in this Detailed Description, and the Claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Certain terminology and derivations thereof may be used in the following description for convenience in reference only and will not be limiting. For example, words such as "front", "back", "right," and "left" would refer to directions in the drawings to which reference is made unless otherwise stated. References in the singular tense include the plural, and vice versa, unless otherwise noted.

The present description includes one or more non-limiting embodiments for a flotation device in the form of a vehicle. In one or more non-limiting embodiments, the presently disclosed invention is inflatable and includes inflatable air chambers. The flotation device that is in the form of a vehicle, as described in one or more non-limiting embodiments, has a front side, a back side, a right side, and a left side. The flotation device in the form of a vehicle is constructed of a water-resistant plastic material for recreational use within a body of water such as pool, river, or lake. The flotation device in the form of a vehicle, as described herein in one or more non-limiting embodiments, resembles a muscle car, such as a 1969 Chevrolet Camaro, in a convertible model whereby accompanying details, logos, and decals associated with the muscle car are displayed on the flotation device to give the flotation device a fun and unique design that appeals to many users.

In a non-limiting embodiment, the flotation device in the form of a vehicle typically seats one to two adults with the ability to include an additional child bringing the total occupancy seated within the flotation device in the form of a vehicle to three individuals seated at a given time. Additionally, the flotation device includes compartments located in the back behind a seating area, whereby a separate cooler can be held and stored, and portable speakers can be placed adding to the enjoyment occupants of the flotation device can experience while relaxing within the flotation device. Additional details for the flotation device in the form of a vehicle and its various components are provided below with respect to the Figures.

Referring now to FIG. 1, FIG. 1 is a pictorial illustration of a flotation device in the form of a vehicle according to one non-limiting embodiment. FIG. 1 shows an example of a flotation device in the form of a vehicle 100. The flotation device in the form of a vehicle 100 includes a body 101. The body 101 includes a front side, a back side, a right side, and a left side. In one or more non-limiting embodiments, the body 101 of the flotation device in the form of a vehicle 100 resembles a muscle car. The muscle car resemblance may include but is not limited to such make and models such as a 1969 Chevrolet Camaro, a 1968 Ford Mustang GT500, and other make and models that fall within the muscle car designation.

Figure 2:
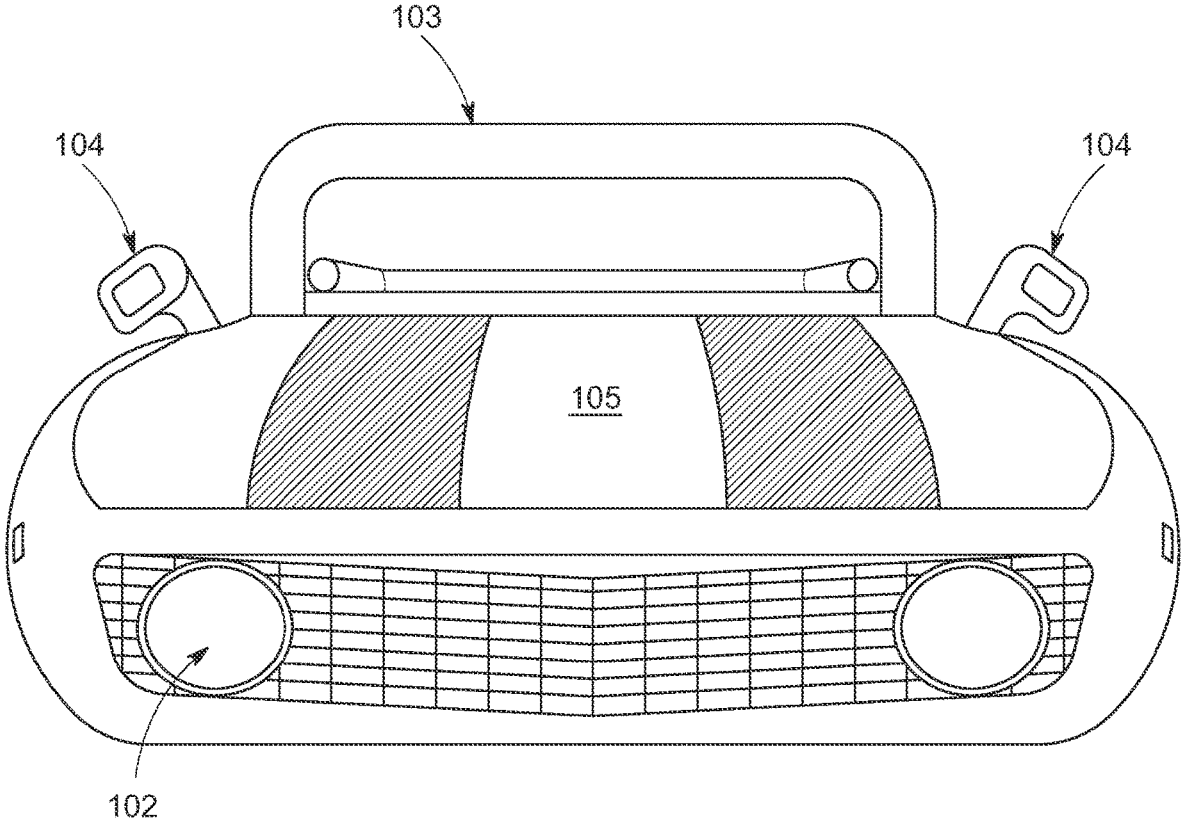
FIG. 2 is a front view of an exemplary embodiment of a flotation device in the form of a vehicle.

Referring now to FIG. 2, FIG. 2 is front view of a flotation device in the form of a vehicle with a non-limiting embodiment. FIG. 2 shows the front of the body 101. The front of the body 101 displays a front grill 102 resembling a front grill associated with the aforementioned muscle car. In one or more non-limiting embodiments, the front grill 102 may include a name and logo (not shown) identifying the manufacturer of the flotation device. Additionally, the front side of the body 101 displays decals associated with the muscle car on a hood area 105.

In one or more non-limiting embodiments, a side view mirror 104 is connected to the right side of the body 101 and to the left side of the body 101. Additionally, a windshield frame 103 is connected to the body 101. The windshield frame 103 is positioned in-line with the side view mirrors 104 where an end of the windshield frame 103 is connected to the right side of the body 101 adjacent to a right side view mirror 104 and another end of the windshield frame 103 is connected to the left side of the body 101 adjacent to a left side view mirror 104. The connected windshield frame 103 extends over a width of the body 101.

Figure 3:
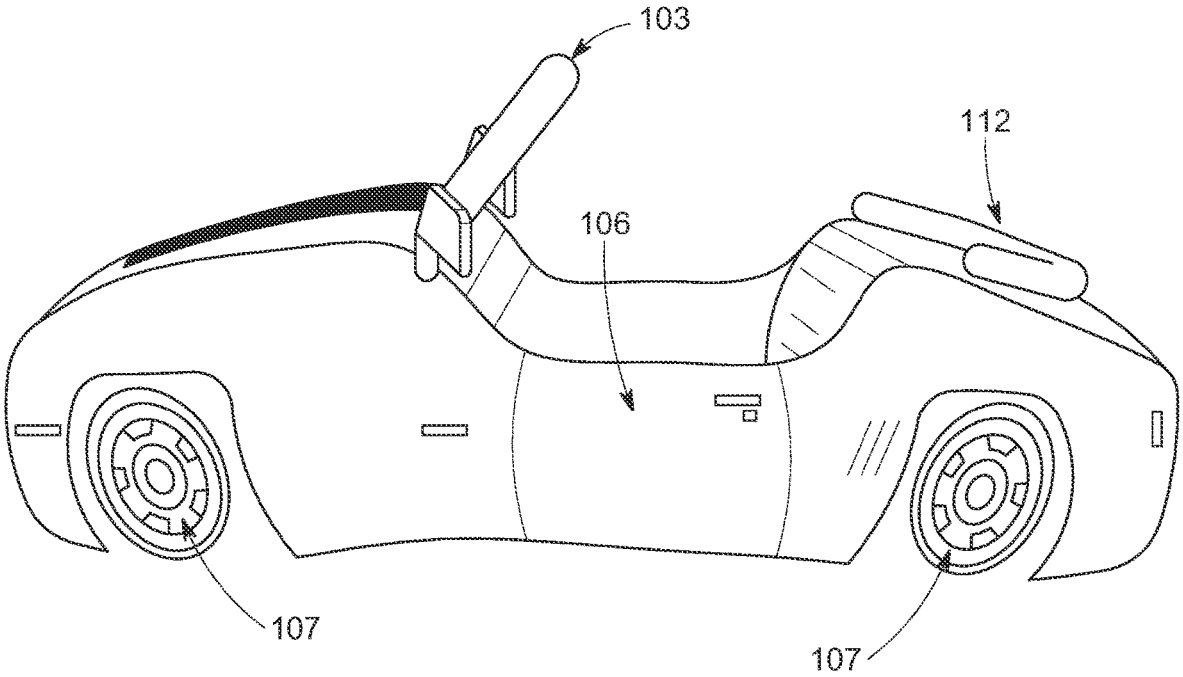
FIG. 3 is a side view of an exemplary embodiment of a flotation device in the form of a vehicle.

Referring now to FIG. 3, FIG. 3 is a side view of a flotation device in the form of a vehicle with a non-limiting embodiment. FIG. 3 shows the left side of the body 101. A door 106 and tires 107 are displayed on the left side of the body 101. Additionally, the door 106 and tires 107 are displayed on the right side of the body 101. In one or more non-limiting embodiments, a folded convertible top 112 is located on the back of the body 101. The folded convertible top 112 is positioned behind a seating area 108, which is displayed in FIG. 4.

Figure 4:
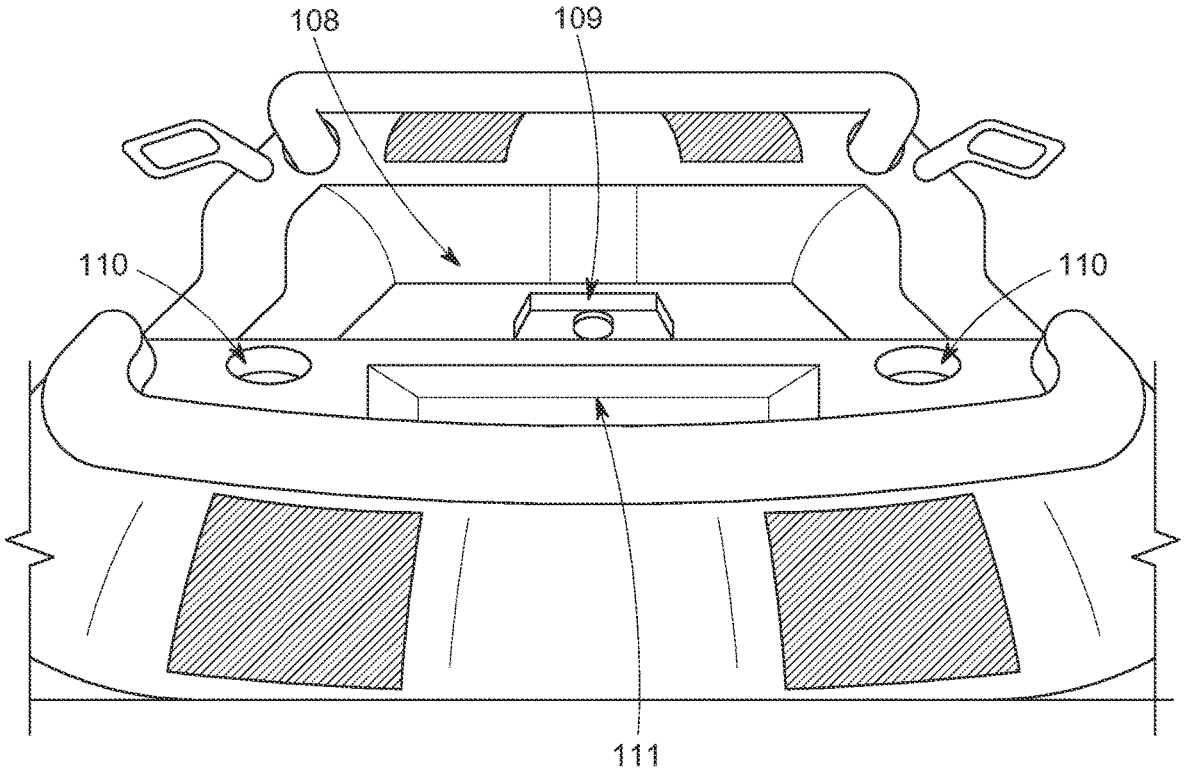
FIG. 4 is a back view of an exemplary embodiment of a flotation device in the form of a vehicle.

Referring now to FIG. 4, FIG. 4 is a back view of a flotation device in the form of a vehicle 100 with a non-limiting embodiment. FIG. 4 shows the back of the body 101. A seating area 108 is within an interior of the body 101. The seating area 108 is positioned between the front and back of the body 101. Located within the seating area 108 are one or more cupholders 109. In one or more non-limiting embodiments, an open compartment area 111 is located in the back of the body 101. The open compartment area 111 is positioned behind the seating area 108 and provides for placement of one or more items. Such items may include a cooler in some cases, but any other type of useful item may alternatively be included in the seating area 108 or the open compartment area 111 in the flotation device 100. Additionally, one or more speaker holders 110 may be located in the back of the body 101. The speaker holders 110 are positioned behind the seating area 108 for placement of portable speakers so that the users can project and hear their music from the speakers that may be stored temporarily in the flotation device 100.

Figure 5:
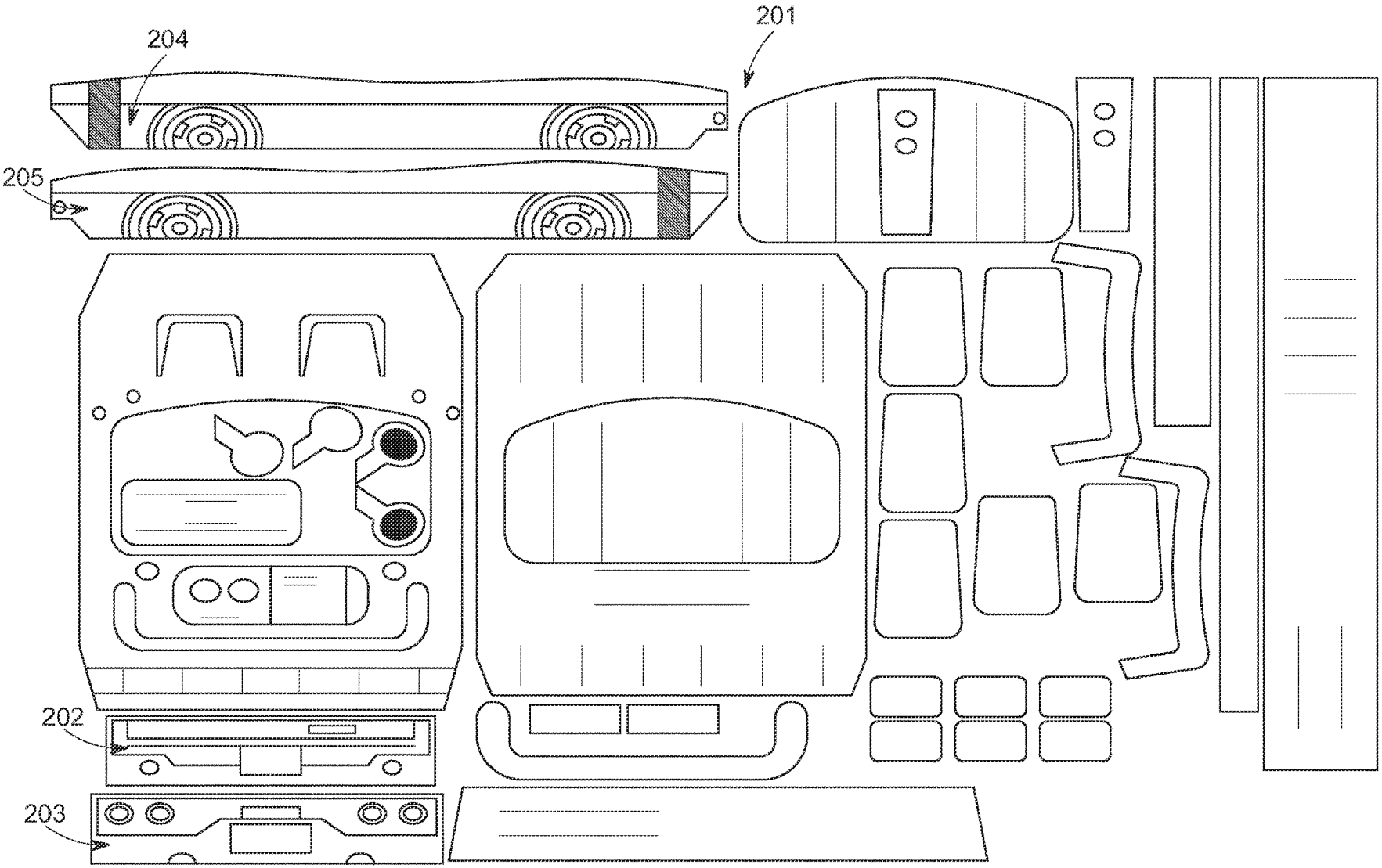
FIG. 5 is cutout sheet layout of the components associated with an exemplary embodiment of a flotation device in the form of a vehicle.

Referring now to FIG. 5, FIG. 5 provides an example of a cutout sheet 201 associated with a flotation device in the form of a vehicle. The cutout sheet 201 includes components of the flotation device in the form of a vehicle 100 in a two-dimensional form. The two-dimensional components are cut and removed from the cutout sheet 201 and then connected together to form the flotation device in a vehicle form 100 in one or more non-limiting embodiments. The connection means includes, but is not limited to bonding with adhesives, fasteners, or any other means of attachment known in the art.

In one or more non-limiting embodiments, the cutout sheet 201 includes components in a two-dimensional form representing a front side 202, a back side 203, a right side 204, and a left side 205, among other additional components of the flotation device in the form of a vehicle 100, wherein the aforementioned components are connected together to form the body 101. In one or more non-limiting embodiments, the components included in the cutout sheet 201 are non-limiting and customizable in terms of size, shape, and color.

Many other advantages and benefits are offered by the flotation device in the form of a vehicle as described herein in one or more non-limiting embodiments. The flotation device in a vehicle form may provide a novel means for providing a relaxation experience when using the flotation device in a pool, lake, or other body of water.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed:

1. A flotation device, comprising:

a body that is inflatable and is inflatable representation of a vehicle having a front side, a back side, a right side, and a left side;

a seating area within an interior of the body of the flotation device;

two first shapes that are an inflatable representation of two side view mirrors; and a second shape that is an inflatable representation of a windshield frame, wherein the body is an inflatable representation of a sports car, wherein the sports car comprises an inflatable representation of doors, tires, and accompanying logos and decals associated with the sports car, wherein the sports car resembles a convertible version of the sports car, further comprising an inflatable representation of a convertible roof, wherein the convertible roof is folded and in an open position as displayed on the body of the flotation device.

2. The flotation device of claim 1, wherein the seating area is configured to accommodate a minimum of two adults.

3. The flotation device of claim 1, wherein one or more cupholders are a part of the seating area.

4. The flotation device of claim 1, further comprising an open compartment area located behind the seating area and in the back of the flotation device for placement of one or more items, wherein the one or more items comprises a cooler or other useful items in the flotation device.

5. The flotation device of claim 1, wherein the flotation device further comprises speaker holders located behind the seating area for placement of portable speakers.

6. An inflatable flotation device, comprising:

a body that is inflatable and is inflatable representation a car having a front side, a back side, a right side, and a left side;

a seating area within an interior of the body of the flotation device;

two first shapes that are an inflatable representation of two side view mirrors; and a second shape that are an inflatable representation of a windshield frame, wherein the body resembles a convertible version having an inflatable representation of open convertible roof resembling a convertible roof folded on the body.

7. The inflatable flotation device of claim 6, wherein the seating area is configured to seat a minimum of two adults.

8. The inflatable flotation device of claim 6, wherein one or more cupholders are a part of the seating area.

9. The inflatable flotation device of claim 6, further comprising an open area located behind the seating area and in the back of the flotation device for placement of one or more items, wherein the one or more items comprises a cooler or other useful items in the flotation device.

10. The inflatable flotation device of claim 6, wherein the flotation device further comprises speaker holders located behind the seating area for placement of portable speakers.

11. An inflatable flotation device, comprising:

a body that is inflatable and is inflatable representation of a convertible having a front side, a back side, a right side, and left side;

wherein the body displays doors, tires, a seating area within an interior of the body of the flotation device;

two first shapes that are an inflatable representation of two side view mirrors; and a second shape that are an inflatable representation of a windshield frame, wherein the body has an inflatable representation of an open convertible roof resembling a convertible roof folded on the body of the convertible.

12. The inflatable flotation device of claim 11, wherein the flotation device comprises one or more open areas located behind the seating area and in the back of the flotation device for placement of one or more items, wherein the one or more items comprises a cooler, portable speakers, or other useful items in the flotation device.

* * * * *